US011389044B2

(12) United States Patent
Kwon et al.

(10) Patent No.: US 11,389,044 B2
(45) Date of Patent: Jul. 19, 2022

(54) DISH WASHER

(71) Applicant: LG Electronics Inc., Seoul (KR)

(72) Inventors: Soonyong Kwon, Seoul (KR); Yongjin Choi, Seoul (KR); Kyuchang Jung, Seoul (KR); Shinwoo Han, Seoul (KR); Pilsu Kim, Seoul (KR); Sangsoo Ahn, Seoul (KR)

(73) Assignee: LG Electionics Inc., Seoul (KR)

( * ) Notice: Subject to any disclaimer, the term of this patent is extended or adjusted under 35 U.S.C. 154(b) by 0 days.

(21) Appl. No.: 16/918,633

(22) Filed: Jul. 1, 2020

(65) Prior Publication Data

US 2021/0000324 A1 Jan. 7, 2021

(30) Foreign Application Priority Data

Jul. 2, 2019 (KR) ..... 10-2019-0079318

(51) Int. Cl.
*A47L 15/42* (2006.01)

(52) U.S. Cl.
CPC ..... *A47L 15/4219* (2013.01); *A47L 15/4225* (2013.01); *A47L 15/4234* (2013.01)

(58) Field of Classification Search
CPC .. A47L 15/00; A47L 15/0023; A47L 15/0026; A47L 15/0028; A47L 15/10; A47L 15/4214; A47L 15/4219; A47L 15/4225; A47L 15/424; A47L 15/4246
See application file for complete search history.

(56) References Cited

U.S. PATENT DOCUMENTS 6,874,248 B2 * 4/2005 Hong ..... D06F 58/08 34/239

FOREIGN PATENT DOCUMENTS

| | | | |
|---|---|---|---|
| EP | 3002358 | 4/2016 | |
| JP | 2007117315 | 5/2007 | |
| KR | 1020180015929 | 2/2018 | |
| KR | 1020180115636 | 10/2018 | |
| WO | WO-2018026221 A * | 2/2018 | ..... A47L 15/4278 |

OTHER PUBLICATIONS

Machine Translation of Lee, WO-2018026221-A1, Feb. 2018. (Year: 2018).*
Extended European Search Report in EP Appln. No. 20183361.3, dated Dec. 8, 2020, 7 pages.

* cited by examiner

*Primary Examiner* — David G Cormier
(74) *Attorney, Agent, or Firm* — Fish & Richardson P.C.

(57) ABSTRACT

A dish washer includes a tub defining a washing space, a base disposed below the tub and defining a space below the tub, a sump disposed in the space defined by the base and configured to store water, a washing pump disposed in the space defined by the base and configured to supply the water stored in the sump to the washing space, and an air jet generator having a venturi shape including an air inlet provided on one side, an inlet having a downward opening, and an outlet provided above a bottom surface of the tub. The air jet generator further includes a tub mounting portion fixing an upper portion of the air jet generator to the bottom surface of the tub and a base fixing portion disposed below the tub mounting portion, the base fixing portion coupling a lower portion of the air jet generator to the base.

20 Claims, 12 Drawing Sheets

DISH WASHER

CROSS-REFERENCE TO RELATED APPLICATION

The present disclosure claims priority to and the benefit of Korean Patent Application No. 10-2019-0079318, filed on Jul. 2, 2019, the disclosure of which is incorporated herein by reference in its entirety.

TECHNICAL FIELD

The present disclosure relates to a dish washer, and more particularly, to a dish washer including an air jet generator which generates an air bubble in water.

BACKGROUND

A dish washer is a household appliance which washes a food debris on a surface of the dish washer by using high-pressure water sprayed from a spray nozzle.

The dish washer includes a tub in which a washing tank is formed, and a sump which is mounted on a bottom surface of the tub to store the water. The water stored in the sump is moved to an internal space of the tub by a pumping action of a washing pump and washes a dish disposed in the internal space of the tub. In addition, foreign substances in the water are filtered by a filter, and then, the water flows into the sump. The water circulates the sump and the tub so as to wash the dish.

A conventional dish washer may disclose an air jet generator which forms air bubbles in water supplied to a tub using a portion of water fed by a washing pump.

However, in the above-described air jet generator, a flow direction of the water is horizontal. Accordingly, when an upper space inside the pipe is not fully filled with the water, there may be a problem that air bubbles are not easily formed by depressurizing or pressurizing the water.

Moreover, when the air jet generator is disposed in a state where the air jet generator is not fixed inside a space formed by a base, there may be a problem that a connection structure of the air jet generator is damaged by vibrations that are generated when the dish washer is carried.

SUMMARY

The present disclosure describes a structure capable of stably fixing an air jet generator to an inside of a dish washer.

Aspects of the present disclosure are not limited to the above-described ones.

Additionally, other aspects and advantages that have not been mentioned can be clearly understood from the following description and can be more clearly understood from implementations. Further, it will be understood that the aspects and advantages of the present disclosure can be realized via means and combinations thereof that are described in the appended claims.

According to one aspect of the subject matter described in this application, a dish washer includes a tub defining a washing space, a base disposed below the tub and defining a space below the tub, a sump disposed in the space defined by the base and configured to store water, a washing pump disposed in the space defined by the base and configured to supply the water stored in the sump to the washing space, and an air jet generator having a venturi shape including (i) an air inlet provided on one side, (ii) an inlet having a downward opening, and (iii) an outlet provided above a bottom surface of the tub. The air jet generator can be configured to receive a portion of the water discharged from the washing pump and generate air bubbles in the water. Moreover, the air jet generator may further include (i) a tub mounting portion fixing an upper portion of the air jet generator to the bottom surface of the tub and (ii) a base fixing portion disposed below the tub mounting portion, the base fixing portion coupling a lower portion of the air jet generator to the base.

Implementations according to this aspect may include one or more of the following features. For example, the base fixing portion may include a fixing rib which protrudes outward from a peripheral surface of the air jet generator, extends vertically, and is coupled to the base.

In some examples, the base may include an air jet generator fixing portion, the air jet generator fixing portion including a fixing groove mounting a portion of the fixing rib. The fixing groove may be opened upward.

In some examples, the air jet generator fixing portion may include a first plate in contact with the fixing rib and configured to limit a longitudinal movement of the air jet generator and a pair of second plates extending perpendicularly from both ends of the first plate and configured to limit a lateral movement of the air jet generator.

In some examples, the fixing rib may include a fixing rib groove, the fixing rib groove provided towards an upward direction in a lower end portion of the fixing rib. The first plate may be inserted into the fixing rib groove.

In some implementations, a vertical protrusion may be disposed at an end portion of the fixing rib. The vertical protrusion may be perpendicularly provided in both directions and may be adjacent to each of the pair of second plates.

In some examples, the pair of second plates may be disposed to be in contact with both ends of the vertical protrusion.

In some implementations, the tub mounting portion may have a plate shape extending radially from an upper peripheral surface of the air jet generator and may be in contact with the bottom surface of the tub and below the bottom surface of the tub.

In some examples, the tub mounting portion may include (i) an upper fixing plate which circumferentially protrudes on an outer peripheral surface of the air jet generator and is disposed below the bottom surface of the tub and (ii) an upper fixing portion which passes through a lower hole provided in the bottom surface of the tub, the upper fixing portion protruding upward.

In some examples, the dish washer may further include a fixing ring coupled to the upper fixing portion and configured to limit a downward movement of an air pulverizing pipe included in the air jet generator.

In some implementations, the fixing ring may provide a plurality of reinforcing ribs.

In some examples, the plurality of reinforcing ribs may be provided perpendicular to an outer peripheral surface of the fixing ring at regular intervals.

In some implementations, the dish washer may further include a sealer disposed between the upper fixing plate and the fixing ring. In some examples, the upper fixing portion may provide a thread to fasten the fixing ring to the outer peripheral surface of the air pulverizing pipe included in the air jet generator.

In some implementations, the upper fixing portion may have a tubular shape protruding upward from the upper fixing plate. In some examples, the dish washer may further include a lower peripheral plate provided on a lower end portion of an air pulverizing pipe included in the air jet generator and providing a surface parallel to the upper fixing plate.

In some examples, the lower peripheral plate may have a ring shape extending radially on an outer peripheral surface of a first pipe included in the air jet generator. In some examples, the lower peripheral plate may provide a cut surface configured to limit a longitudinal movement of the air jet generator.

In some implementations, the air jet generator may include an air pulverizing pipe including a first pipe providing (i) an inlet at a lower side of the air pulverizing pipe, (ii) an opening in a water flowing direction, and (iii) a cross-sectional area reducing in the water flowing direction, and a second pipe disposed above the first pipe, the second pipe providing (i) an opening in the water flowing direction and (ii) a cross-sectional area increasing in the water flowing direction, and an air tab disposed at an upper portion of the second pipe and vertically provided with a plurality of air holes in the second pipe. An air inlet hole may be provided around a peripheral surface of the second pipe to communicate with an external component through an inlet end portion of the second pipe.

In some examples, the tub mounting portion may be provided on an upper end portion of the second pipe. The base fixing portion may extend downward from the tub mounting portion and may be provided to extend to the first pipe.

The air jet generator in the dish washer may be stably disposed even when external vibrations are applied through a displacement of the air jet generator to the tub and the base. Further, damages to the air jet generator can be limited by coupling the air jet generator in a plurality of directions.

Specific contents of other implementations are included in the detail description and drawings.

DETAILED DESCRIPTION

Hereinafter, the present disclosure will be described with reference to the drawings for explaining the dish washer according to an implementation of the present disclosure.

Hereinafter, an exemplary dish washer and an exemplary flow of water inside the dish washer when a dish is washed will be described with reference to FIGS. 1 and 2.

Figure 1:
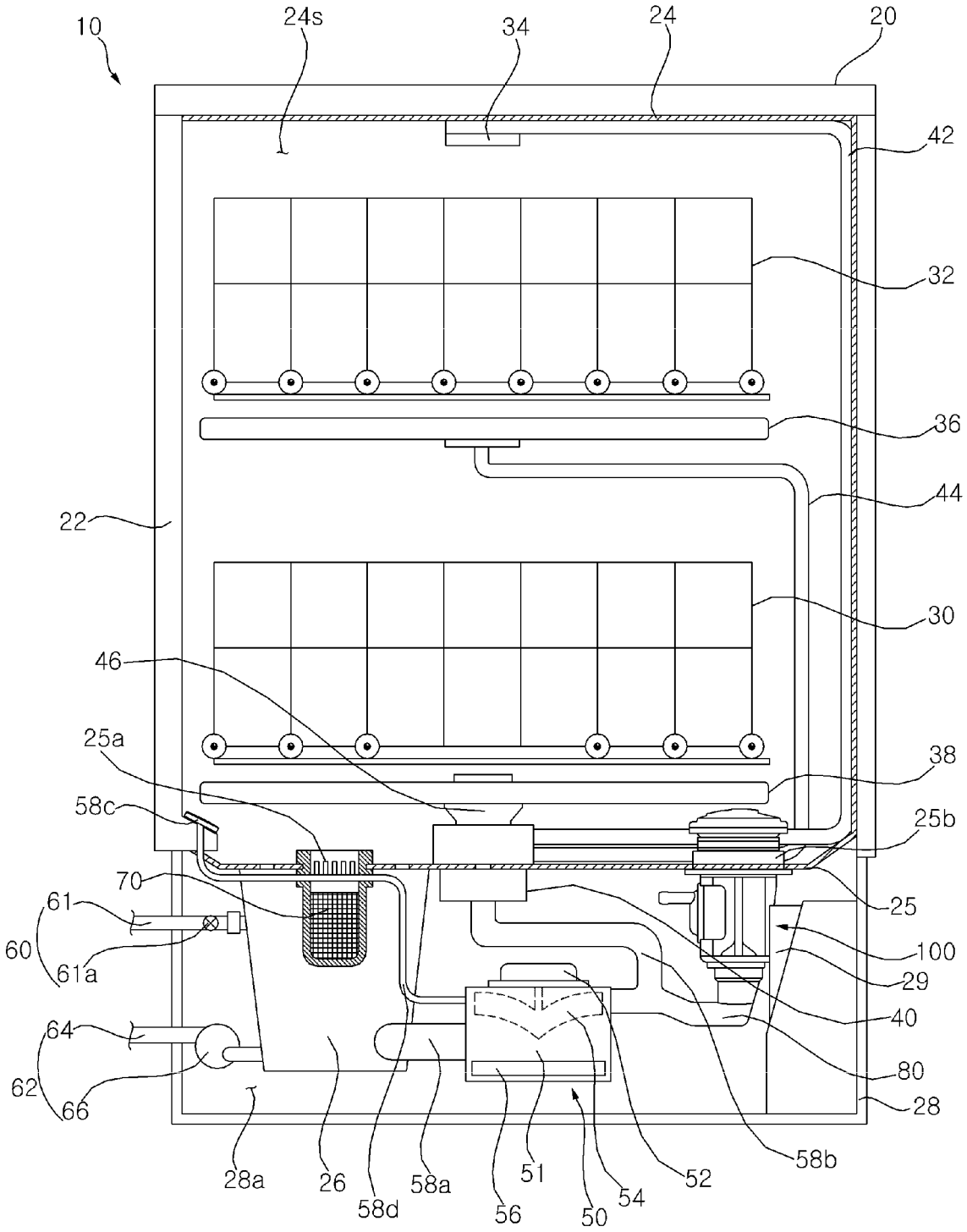
FIG. 1 is an exemplary schematic cross-sectional view of a dish washer.
Figure 2:
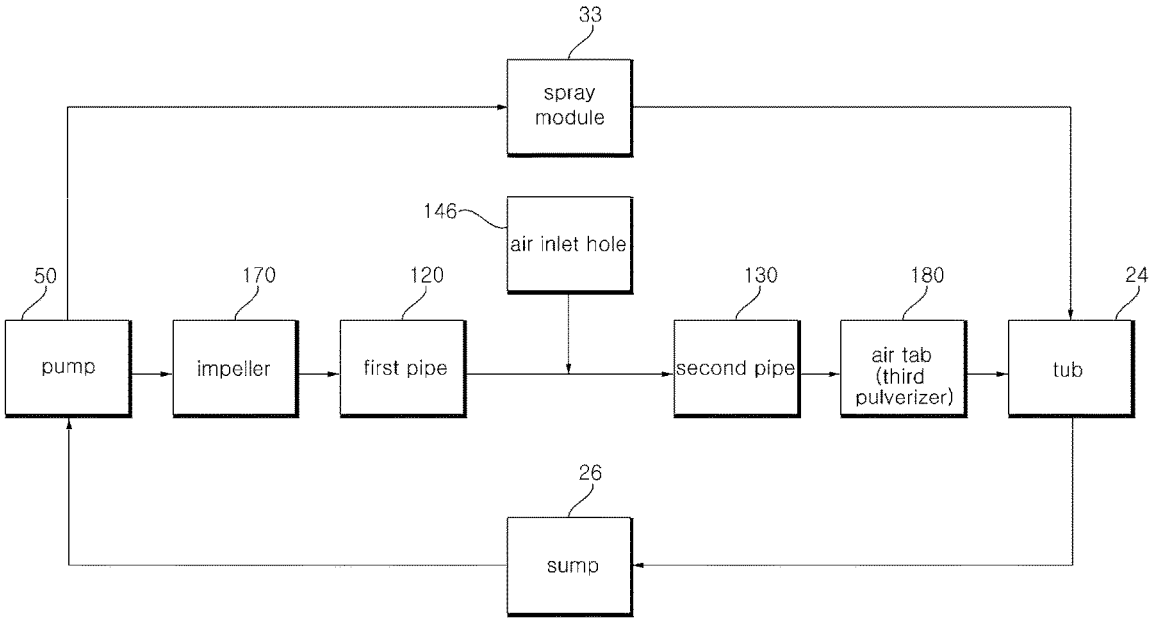
FIG. 2 is an exemplary block diagram illustrating a flow of water in the dish washer of FIG. 1.
Figure 3:
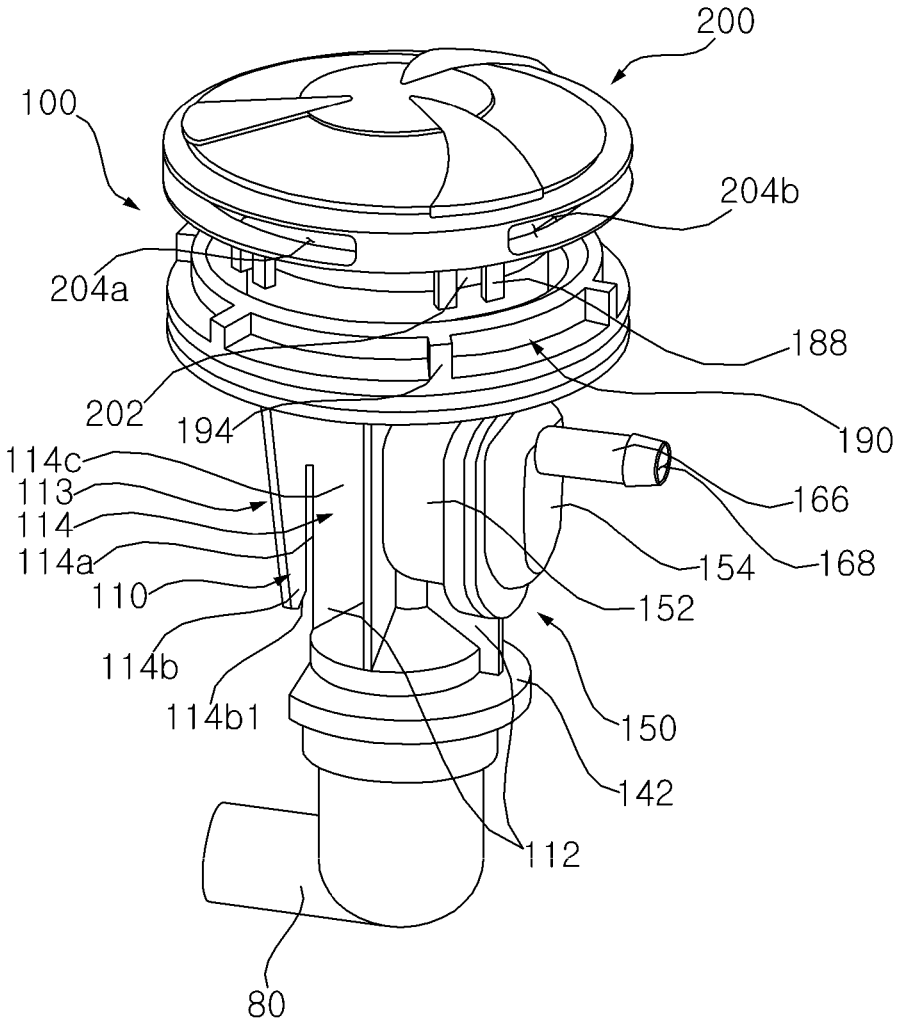
FIG. 3 is an exemplary diagram illustrating a perspective view of an air jet generator.
Figure 4:
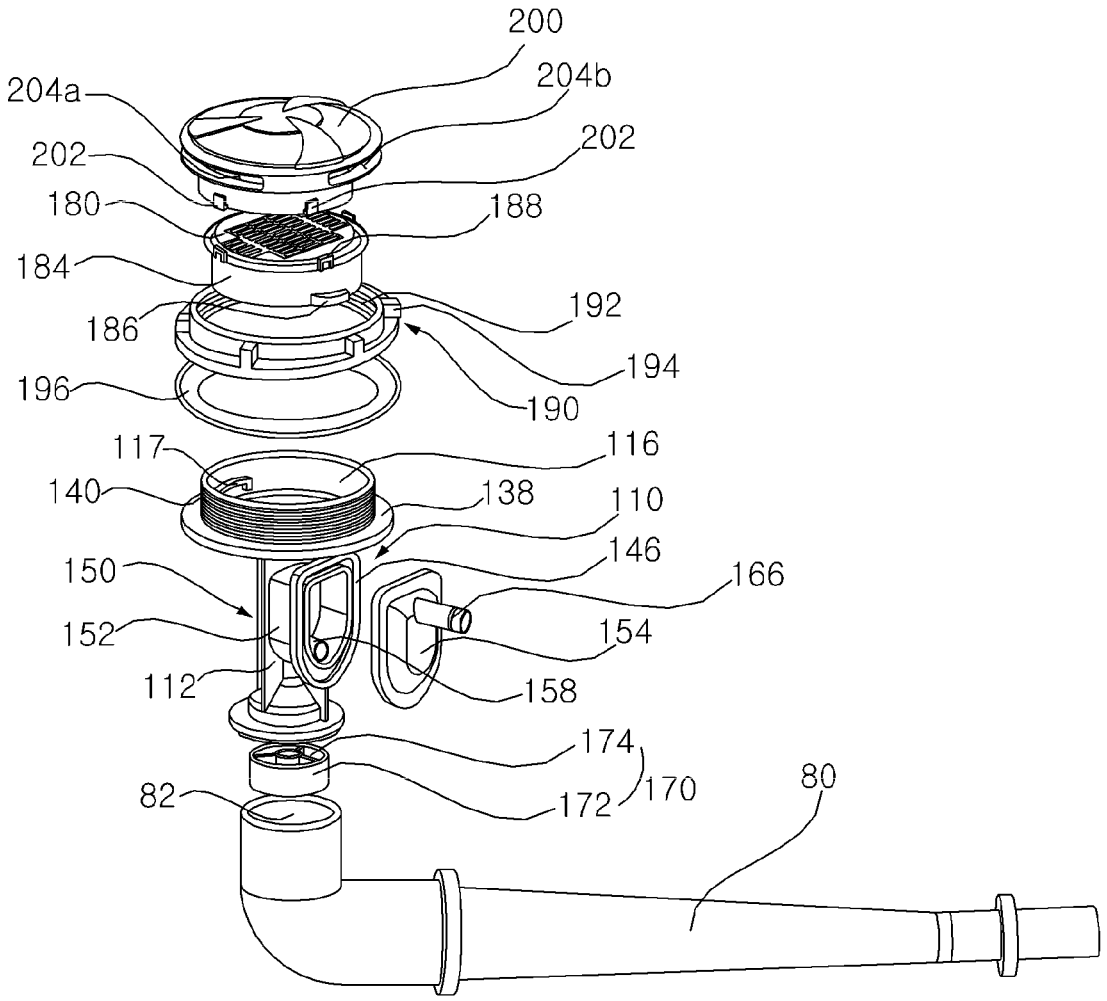
FIG. 4 is an exemplary diagram illustrating an exploded perspective view of the air jet generator.
Figure 5:
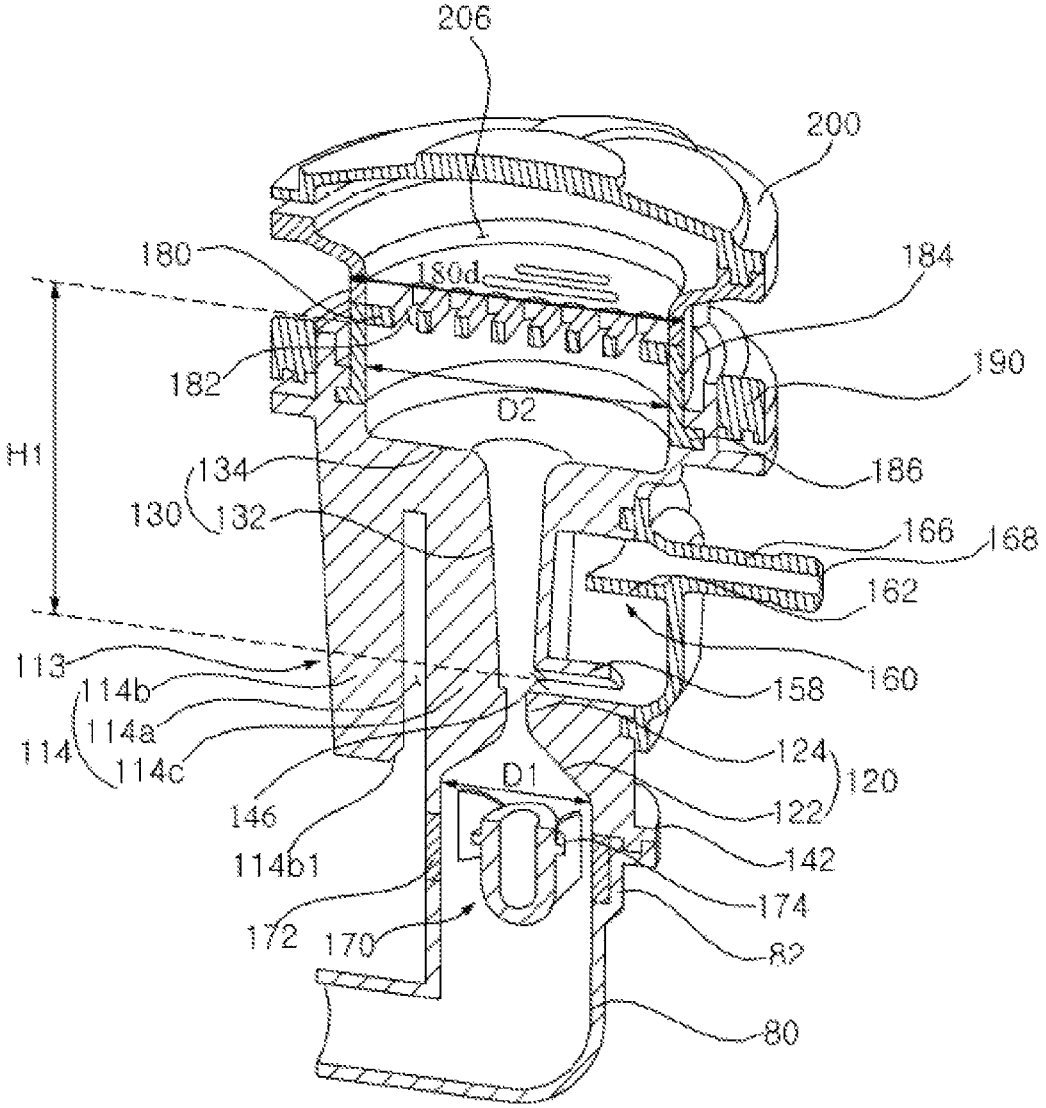
FIG. 5 is an exemplary diagram illustrating a side cross-sectional perspective view of the air jet generator.
Figure 6A:
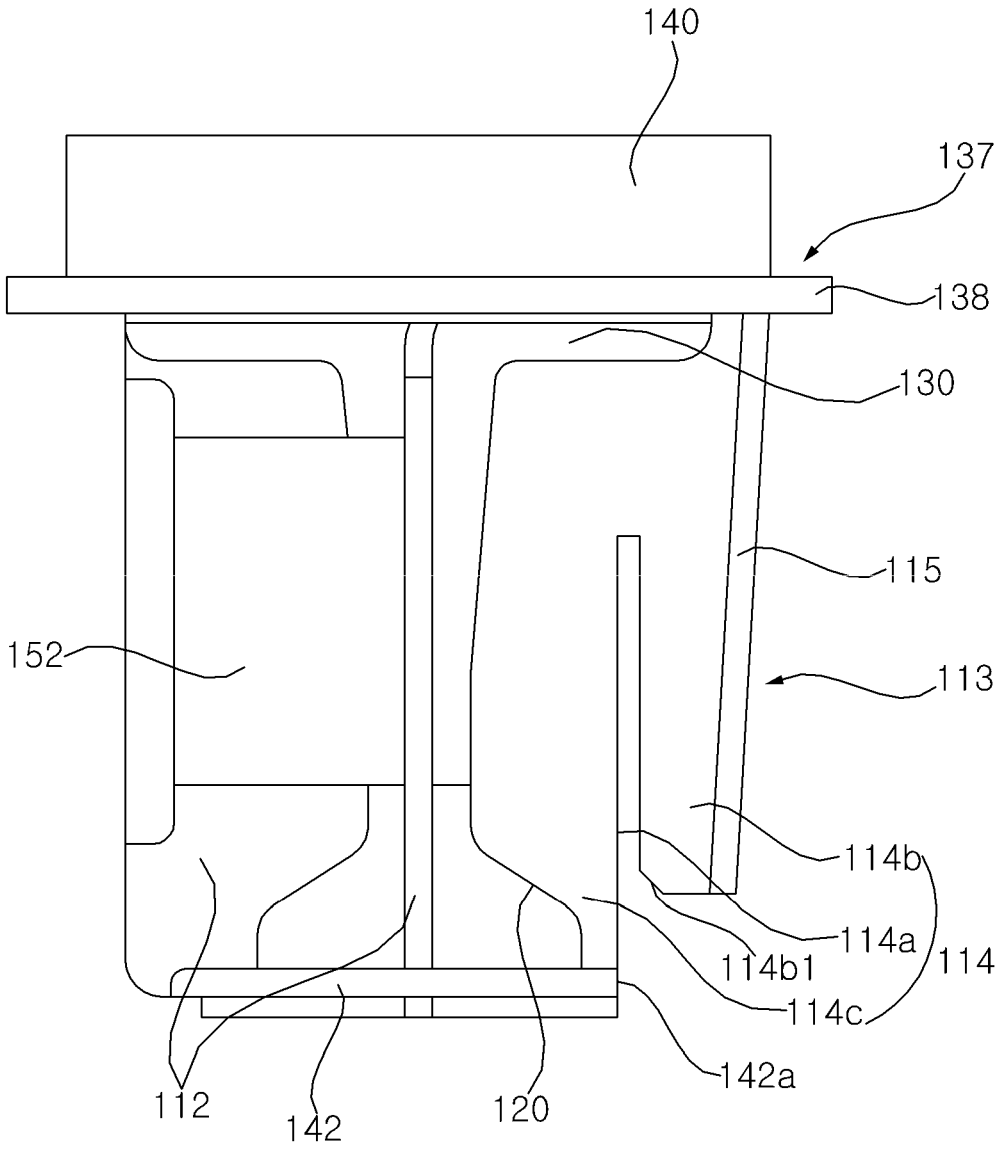
FIG. 6A is an exemplary diagram illustrating a side view of the air jet generator.
Figure 6B:
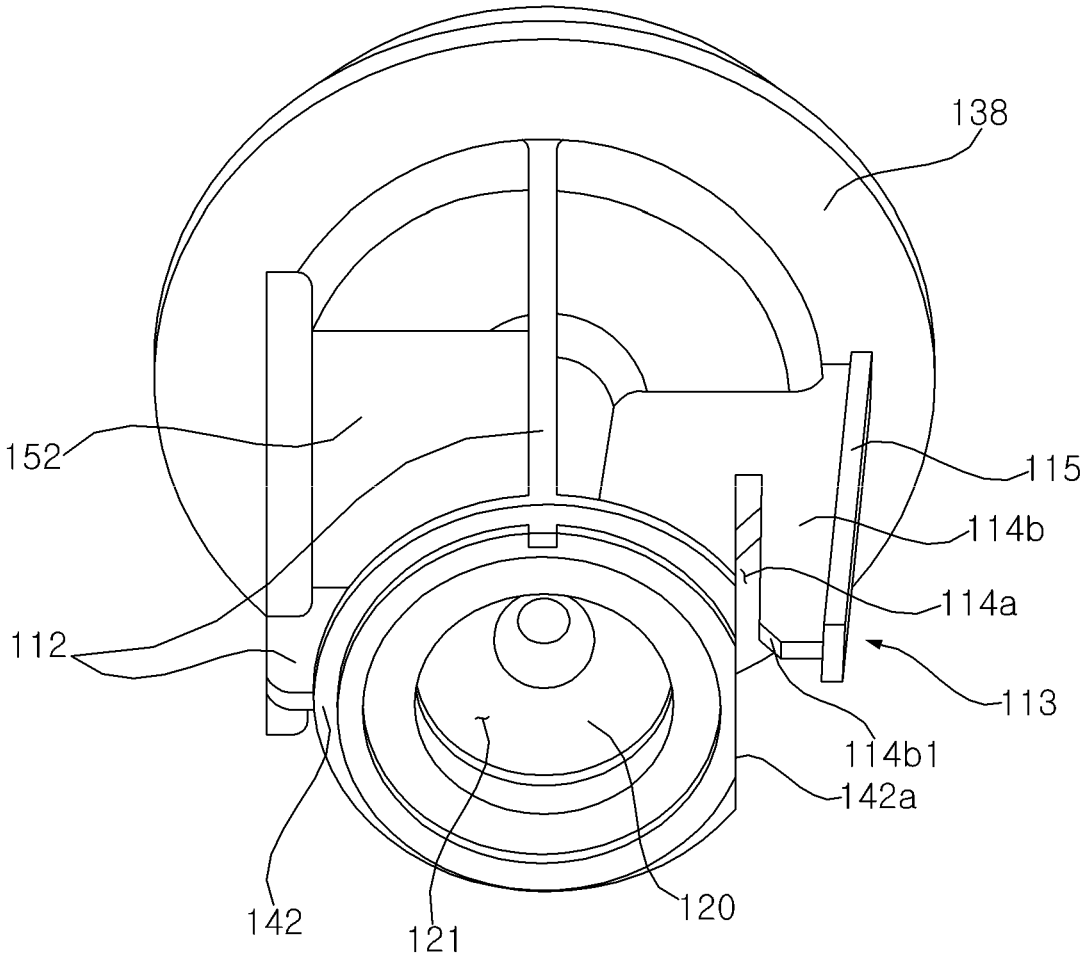
FIG. 6B is an exemplary diagram illustrating a bottom perspective view of the air jet generator.

With reference to FIG. 1, a dish washer 10 may include a cabinet 20 forming an outline, a door 22 which is coupled to the cabinet 20 and opens or closes an inside of the cabinet 20, a tub 24 which is installed inside the cabinet 20 and forms a washing space 24*s* to which the water or steam is applied, and a base 28 which is disposed below the tub 24 and forms a space below the tub 24.

The dish washer 10 may further include a dispenser which stores a detergent introduced by a user and introduces the detergent into the tub 24 in a washing step. The dispenser may be disposed in the door 22. The tub 24 may form the washing space 24*s* where the dish is disposed.

The base 28 may separate the tub 24 from the ground by a predetermined distance. The base 28 forms a space where a sump 26 and a washing pump 50 are disposed. The base 28 may include an air jet generator fixing portion 29 which fixes the air jet generator 100.

The dish washer 10 may further include racks 30 and 32 storing a dish inside the tub 24, a spray module 33 spraying the water toward the dish accommodated in the racks 30 and 32, a sump 26 supplying the water to the spray module 33, and a washing pump 50 pressure-feeding the water stored in the sump 26 to the spray module 33.

The spray module 33 can be configured to spray the water toward the dish, and may include spray nozzles 34, 36, and 38 and supply pipes 42, 42, and 46 connecting the washing pump 50 and the spray nozzles 34, 36, and 38 to each other.

The dish washer 10 may further include a washing motor 52 driving the washing pump 50, and a brushless direct current motor (BLDC) which can control a rotating speed of the washing motor 52.

The dish washer 10 may further include a water supply module 60 which supplies water to the sump 26 or the spray module, a water discharge module 62 which is connected to the sump 26 and discharges the water from the sump 26, a filter module 70 installed in the sump 26 and filters the water, and a heating module which is installed in the sump 26 and heats the water.

In some implementations, the dish washer 10 may include the plurality of spray nozzles 34, 36, and 38, the plurality of supply pipes 42, 44, and 46 through which the water pressure-fed from the washing pump 50 are respectively supplied to the plurality of spray nozzles 34, 36, and 38, and a channel switcher 40 which supplies the water pressure-fed from the washing pump 50 to at least one of the spray nozzles 34, 36, and 38.

The water supply module 60 can be configured to receive the water supplied from the outside and supply the water to the sump 26, and open or close a water supply valve 61*a* disposed in a water supply flow path 61 to supply the water from the outside into the sump 26. The water discharge module 62 can be configured to discharge the water stored in the sump 26 to the outside and includes a water discharge channel 64 and a water discharge pump 66.

The filter module 70 can be configured to filter foreign matters such as a food debris contained in the water and can be disposed in a path of the water flowing from the tub 24 into the sump 26.

The dish washer 10 may further include the washing pump 50 which pressure-feeds the water stored in the sump 26 to the spray nozzles 34, 36, and 38. The washing pump 50 includes a washing pump housing 51, a washing pump impeller 54 which is disposed inside the washing pump housing 51 and rotated to supply the water to the spray nozzles 34, 36, and 38, a washing motor 52 which rotates the washing pump impeller 54, and a heater 56 which heats the water inside the washing pump housing 51.

The washing pump 50 is connected to the sump 26 through the water supply pipe 58*a* and connected to the channel switcher 40 through a water outlet pipe 58*b*. A branching pipe 80 is formed in the water outlet pipe 58*b*, and a portion of the water flowing from the washing pump 50 can flow to an air jet generator 100 through the branching pipe 80.

Steam generated by the heater 56 disposed in the washing pump 50 may flow into a steam nozzle 58*c* through a steam discharge pipe 58*d* and may be supplied into the tub 24 through the steam nozzle 58*c*.

The dish washer 10 may further include the air jet generator 100 which forms air bubbles having a minute size in the water.

In the dish washer 10, a portion of the water supplied by the washing pump 50 is supplied to the air jet generator 100 in addition to the spray module 33 through the branching pipe 80. The portion of the water may include air and the air jet generator 100 may pulverize the air to generate minute air bubbles. The air jet generator 100 is connected to the tub 24 or the sump 26. Accordingly, when the pump is operated, the air jet generator 100 supplies the water having the generated air bubbles to the sump 26, and thus, the water pressure-fed to the spray module 33 includes the air bubbles.

A lower hole through which a portion of an upper side of the air jet generator 100 passes is formed at a bottom of the tub 24. An upper portion of an air pulverizing pipe of the air jet generator 100 passes through the lower hole and will be described below. For example, a portion of the upper portion of the air pulverizing pipe of the air jet generator 100 is disposed at the bottom of the tub 24.

The exemplary flow of the water will be described with reference to FIG. 2. The water stored in the sump 26 of the dish washer 10 is supplied to the spray module 33 through the washing pump 50, the water supplied to the spray module 33 is sprayed to the tub 24, and the water sprayed to the tub 24 flows into the sump 26 again. In the dish washer 10, a portion of the water fed from the washing pump 50 flows into the air jet generator 100 which generates the air bubbles in the water. The portion of the water may flow into the air jet generator 100 through the branching pipe 80.

The portion of the water flowing into the air jet generator 100 may pass through an impeller 170, an air inlet hole 146, the air pulverizing pipe including a first pipe 120 and a second pipe 130, and an air tab 180 to generate the air bubbles in the water. That is, the water flowing into the air jet generator 100 flows swirly by the impeller 170. Thereafter, a speed of the water increases while passing through the first pipe 120, and air flowing into the air inlet hole is primarily pulverized by the washing waster which is rotated at a high speed by the impeller 170 and the first pipe 120. Moreover, the water is secondarily pulverized while passing through the second pipe 130 and thirdly pulverized while passing through the air tab 180, and thus, includes air bubbles having a minute size.

The water including the air bubbles flows into the sump 26 again. For example, the water including the air bubbles may be discharged to the tub 24 and may flow into the sump 26. Accordingly, when the washing pump 50 is operated by operating the dish washer 10, the air bubbles are generated in the water.

Hereinafter, an exemplary implementation and disposition of the air jet generator and a fixing structure of the air jet generator will be described with reference to FIGS. 2 to 11.

In FIGS. 2 to 11, based on displacements of the first pipe 120 and the second pipe 130 in the air pulverizing pipe 110, a direction in which the first pipe 120 is disposed may refer to an upward direction, and a direction in which the second pipe 130 is disposed may refer to a downward direction. Moreover, based on displacements of the air chamber 150 and the fixing rib 114, a direction in which the air chamber 150 is disposed may refer to a forward direction, and a direction in which the fixing rib 114 is disposed may refer to a rearward direction. A direction which is perpendicular to the direction in which the fixing rib 114 and a reinforcing protrusion are disposed may refer to a right-left direction.

The air jet generator 100 is disposed on a rear side of a bottom surface 25 of the tub 24. In some implementations, the air jet generator 100 may be disposed at an edge side of the bottom surface 25 of the tub 24.

Figure 11:
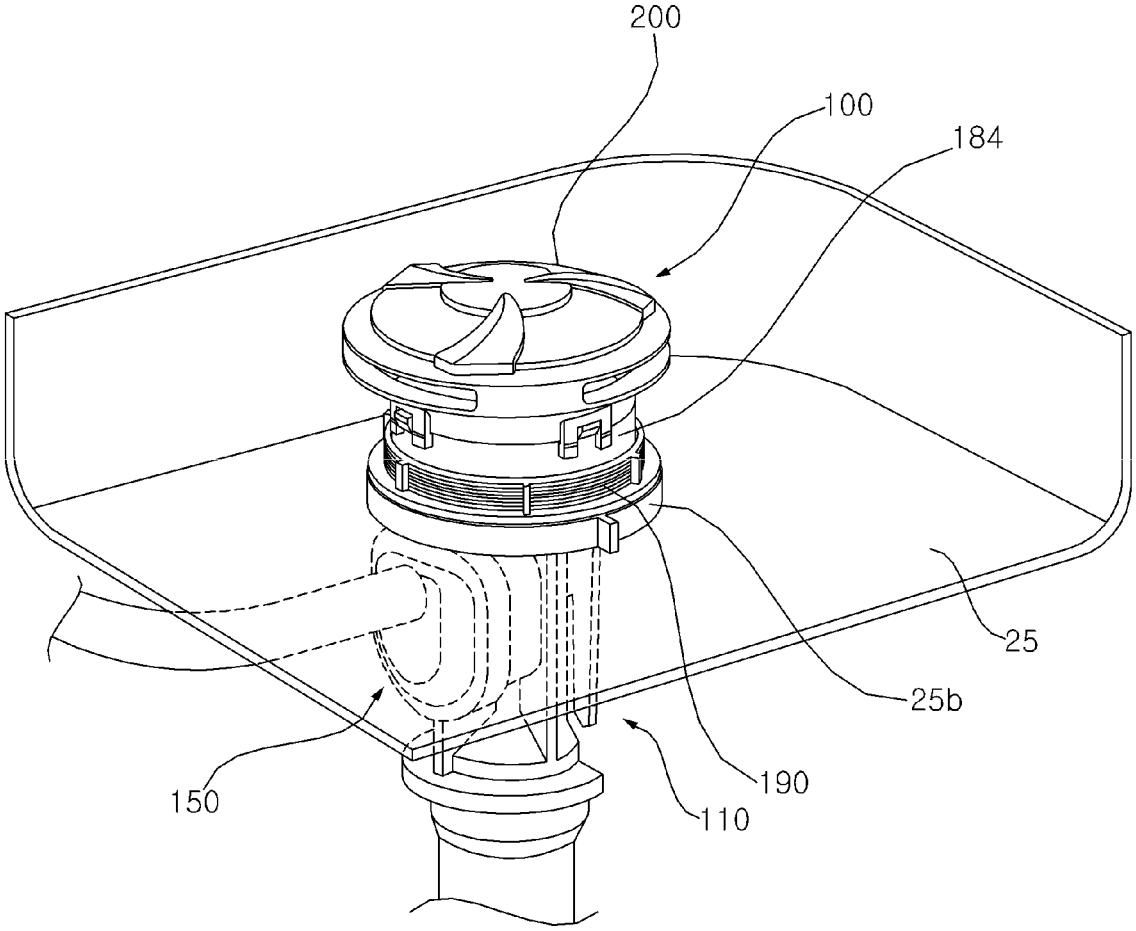
FIG. 11 is an exemplary diagram illustrating a view of the air jet generator mounted on the tub.

Referring to FIG. 11, a mounting hole where a part of the air jet generator 100 passes is formed in a portion on which the air jet generator 100 is mounted, and a mounting surface 25*b* on which the air jet generator 100 is mounted is formed around the mounting hole.

A fixing ring 190 is disposed above the mounting surface 25*b* and will be described later. The mounting surface 25*b* forms a flat surface to be in close contact with a lower side of the fixing ring 190.

The air jet generator 100 may form a channel perpendicular to the bottom surface 25 of the tub 24 or a ground and has a shape of a venturi tube. The air jet generator 100 may include the air pulverizing pipe 110 in which the air inlet hole 146 is formed. In some implementations, an external air may flow from one side of the air inlet hole 146 and through the air inlet hole 146. The air jet generator 100 may further include the air tab 180 which pulverizes the air existing in the water discharged from the air pulverizing pipe, and an air chamber 150 which forms a space for the air flow and the air inlet hole 146 to communicate with an inside of the air pulverizing pipe 110 on one side of a lower portion. Moreover, the air jet generator may further include the impeller 170 which applies a centrifugal force to the water flowing to the air pulverizing pipe 110.

The dish washer 10 may further include the branching pipe 80 which causes a portion of the water flowing from the washing pump 50 to the spray module 33 to flow to the air jet generator 100. For example, an end portion of the branching pipe 80 is coupled to the lower portion of the air pulverizing pipe 110. The branching pipe 80 and the air pulverizing pipe 110 may be coupled to each other using a fusion method.

A portion of the water flowing through the water outlet pipe 58*b* is supplied to the air jet generator 100 through the branching pipe 80. That is, the branching pipe 80 branches off at the water outlet pipe 58*b* and is connected to the air jet generator 100.

The impeller 170 which applies a centrifugal force to the water flowing into the air pulverizing pipe 110 may be disposed at the end portion of the branching pipe 80. An impeller mounting portion 82, mounting the impeller 170, may be formed inside one side of the branching pipe 80. In some implementations, the impeller 170 may be coupled to the impeller mounting portion 82 of the branching pipe 80 by a fusion method.

The impeller 170 includes a cylindrical impeller peripheral portion 172 and a vane 174. The vane 174 may be disposed inside the impeller peripheral portion 172 and may form a swirl in the water. In the impeller 170, an outer surface of the impeller peripheral portion 172 is disposed close to an inside of a discharge end portion of the branching pipe 80. As the water passes through the vane 174, the water is rotated to generate the swirl.

The vane 174 of the impeller 170 applies the centrifugal force to the water flowing through the first pipe 120. In some implementations, the vane 174 of the impeller 170 may be fixed or rotated, and the water passing through the vane 174 is rotated and flows into the air pulverizing pipe 110.

In some implementations, the air pulverizing pipe 110 has the shape of a venturi tube and pulverizes the air from the water, the air flowing through the air inlet hole 146.

In some implementations, the air pulverizing pipe 110 may include the first pipe 120 having a cross-section area of a channel which is reduced in a direction, the direction which the water flows to reduce a pressure of the water flowing through the air pulverizing pipe 110. The air pulverizing pipe 110 may further include the second pipe 130 having a cross-sectional area of a channel which increases in a direction, the direction which the water flows to pressurize the water including the air. Each of the first pipe 120 and the second pipe 130 has the channel with an opening. In some implementations, the channel may be implemented in up-down direction. The first pipe 120 is located on an upstream side of the second pipe 130 and is located below the second pipe 130.

The air inlet hole 146 where the external air flows into the air pulverizing pipe 110 by a generated negative pressure from the air pulverizing pipe 110 is formed on a peripheral surface of a lower end portion of the second pipe 130. In some implementations, the air inlet hole 146 is formed on an upstream end portion of the second pipe 130.

The air pulverizing pipe 110 is disposed below the bottom surface 25 of the tub 24. In some implementations, the air pulverizing pipe 110 is disposed to be perpendicular to the ground or the bottom surface 25 of the tub 24.

In some implementations, the first pipe 120, the second pipe 130, and an air tab mounting portion 116 may be disposed in the air pulverizing pipe 110 in order with respect to the water flowing direction.

The air pulverizing pipe 110 may further include an air tab mounting portion 116, mounting the air tab 180, at the discharge end portion where the water is discharged. In some implementations, the air tab mounting portion 116 may have a shape surrounding the air tab 180 to insert the air tab 180 into the air tab mounting portion 116. The air tab mounting portion 116 is disposed on an upper side of the air pulverizing pipe 110.

In some implementations, a size of an inlet cross section of the first pipe 120 is smaller than a size of a discharge cross section of the second pipe 130. The air pulverizing pipe 110 is disposed to be perpendicular to the ground or the bottom surface 25 of the tub 24. The channel formed inside the air pulverizing pipe 110 is formed to be perpendicular to the ground or the bottom surface 25 of the tub 24.

The first pipe 120 is disposed below the second pipe 130. For example, the water flows from the lower side to the upper side, and thus, the first pipe 120 is disposed on an upstream side of the second pipe 130. In the first pipe 120, the cross-sectional area of the channel is reduced in the flow direction of the water. A length of the channel formed by the first pipe 120 is shorter than a length of the channel formed by the second pipe 130. A diameter of the channel on a lower end portion D1 of the first pipe 120 is smaller than a diameter of the channel on an upper end portion D2 of the second pipe 130.

The first pipe 120 may include a first pipe lower portion 122 of which a channel cross-sectional area is rapidly reduced to reduce the pressure of the water flowing into the air pulverizing pipe 110, and a first pipe upper portion 124 which is disposed on a downstream side of the first pipe lower portion 122 and increases or maintains a velocity of the water flowing through the first pipe lower portion 122.

The first pipe lower portion 122 is disposed below the first pipe upper portion 124. A change ratio of the channel cross-sectional area of the first pipe upper portion 124 is greater than a change ratio of the channel cross-sectional area of the first pipe lower portion 122.

The channel cross-sectional area of the first pipe lower portion 122 is rapidly reduced from the upstream side to the downstream side. For example, a reduction ratio of the channel cross-sectional area of the first pipe lower portion 122 is greater than that of the first pipe upper portion 124. The pressure of the water flowing through the first pipe 120 of the air pulverizing pipe 110 is reduced while passing through the first pipe lower portion 122 and the first pipe upper portion 124 forming a negative pressure.

The second pipe 130 is disposed above the first pipe 120. The second pipe 130 is disposed on a downstream side of the first pipe 120. The channel cross-sectional area of the second pipe 130 increases in the flow direction of the water, and pressurizes the water. The water moving along the second pipe 130 is pressurized, and thus, the air flowing into the air pulverizing pipe 110 through the air inlet hole 146 is secondarily pulverized.

In some implementations, the second pipe 130 may be formed to be longer than the first pipe 120. The second pipe 130 may include a second pipe lower portion 132 which primarily pressurizes the water flowing from the first pipe 120 and a second pipe upper portion 134 which secondarily pressurizes the water passing through the second pipe lower portion 132. The second pipe lower portion 132 slowly pressurizes the water compared to the second pipe upper portion 134. A change ratio of a channel cross-sectional area of the second pipe lower portion 132 is less than that of the second pipe upper portion 134. For example, referring to FIG. 5, a length of a channel of the second pipe lower portion 132 formed in an up-down direction is longer than a length of a channel of the second pipe upper portion 134 formed in the up-down direction. A difference between inner diameters of the channels formed in both end portions of the second pipe lower portion 132 in the up-down direction is less than a difference between inner diameters of the channels formed in both end portions of the second pipe upper portion 134 in the up-down direction.

In the second pipe lower portion 132, the air flowing into the air inlet hole 146 is pulverized by the flow velocity and the centrifugal force of the water. In the second pipe upper portion 134, the channel cross section is rapidly extended. Accordingly, the water is pressurized, and the air existing inside the water can be effectively pulverized.

The second pipe 130 may further include an extended pipe portion which maintains the channel cross section extended by the second pipe upper portion 134. The extended pipe portion is connected to an inner peripheral surface of an air tab peripheral surface 184. The extended pipe portion and the inner peripheral surface of the air tab peripheral surface 184 can adjust a distance of the air tab 180 separated from the air inlet hole 146. In order to effectively pulverize the air by the air tab 180, preferably, a distance H1 of the air tab 180 separated from the air inlet hole 146 is equal to or longer than a diameter 180*d* of the air tab 180. Accordingly, a sum (which is equal to distance H1) of the lengths of the channel formed by the second pipe lower portion 132, the second pipe upper portion 134, the extended pipe portion, and the inner peripheral surface of the air tab peripheral surface 184 is equal to or greater than the diameter 180*d* of the air tab 180.

The air inlet hole 146 is formed on an upstream end portion of the second pipe 130. The air inlet hole 146 is formed on a lower end portion of the second pipe 130.

The air inlet hole 146 may be formed between the first pipe 120 and the second pipe 130. The air inlet hole 146 is formed in a portion where the channel cross section of the first pipe 120 is reduced. The air inlet hole 146 is formed at the upstream end portion of the second pipe 130. The air inlet hole 146 may be formed at a point where the reduction in the pressure of the first pipe 120 ends. The air inlet hole 146 may be formed at a point where the pressurization by the second pipe 130 starts.

The inside of the air pulverizing pipe 110 and the outside of the air pulverizing pipe 110 communicate with each other through the air chamber 150. The air chamber 150 will be described later with respect to the air inlet hole 146. In the air pulverizing pipe 110, the external air can flow to the inside of the air pulverizing pipe 110 through the air inlet hole 146. The outside may refer to the outside of the air pulverizing pipe 110, and may include not only an outside of the cabinet 20 but also the space inside the cabinet 20 and an internal space of the tub 24.

The pressure of the water flowing through the air pulverizing pipe 110 is reduced while passing through the first pipe 120. A negative pressure is generated by the reduction in the pressure of the water passing through the first pipe, and thus, the external air is sucked into the air pulverizing pipe 110 through the air inlet hole 146. The air flowing into the air pulverizing pipe 110 through the air inlet hole 146 is primarily pulverized by the rotating current flowing at a high speed along the first pipe 120.

The air chamber 150 which reduces the noise generated in the air pulverizing pipe 110 may be disposed on one side of the air pulverizing pipe 110. For example, the air chamber 150 may reduce the noise transmitted to the outside through the air inlet hole 146.

In some implementations, the air chamber 150 may form a space where the noise is transmitted. In some implementations, the air chamber 150 may be disposed outside the air pulverizing pipe 110 in which the air inlet hole 146 is formed. IN some implementations, the air chamber 150 may include the air inlet hole 146 which can communicate with the inside of the air pulverizing pipe 110 on one side of the lower end portion.

The air inlet hole 146 is formed on the lower end portion of the air chamber 150. Accordingly, even when the water flows into the air chamber 150, the water is extracted to the air inlet hole 146 formed on the lower end portion of the air chamber 150, and thus, the water is not accumulated inside the air chamber 150. In some implementations, an outside air inlet 168 where the outside air flows into the air chamber 150 may be formed in the air chamber 150. In some implementations, the outside air inlet 168 may be formed in an upper end portion of the air chamber 150. Accordingly, the water flowing into the air chamber 150 is prevented from being extracted to the outside of the air chamber 150.

In some implementations, the air chamber 150 is disposed outside the air pulverizing pipe 110 where the air inlet hole 146 is formed. A space is formed inside the air chamber 150, and the air chamber 150 includes a chamber body 152 of which one side is open and a chamber cover 154 which covers the open one side of the chamber body 152.

In some implementations, the chamber body 152 protrudes from one side of the air pulverizing pipe 110 to form a space therein and may be integrally formed with the air pulverizing pipe 110. Moreover, the chamber cover 154 may be configured to be separated from the chamber body 152 so as to be coupled to the chamber body 152.

In some implementations, the chamber body 152 and the chamber cover 154 may communicate with the inner channel of the air pulverizing pipe 110 and may be constituted by implementations separated from each other to form a space where the noise is propagated. The chamber body 152 and the chamber cover 154 are manufactured into the implementations separated from each other or coupled to each other, and thus, it may be possible to secure the space inside the air chamber 150. For example, the chamber cover 154 may be coupled to the chamber body 152 by a fusion method.

In some implementations, the chamber body 152 may be disposed on the one side forming a periphery of the air pulverizing pipe 110 so that a coupling process including a separate manufacturing process can be omitted. The chamber body 152 is disposed on the one side forming the periphery of the air pulverizing pipe 110 and may play a role of reinforcing rigidities of the air pulverizing pipe 110 together with reinforcement protrusions 112.

In some implementations, the chamber body 152 may be formed on an outer periphery of the air pulverizing pipe 110 where the air inlet hole 146 is formed. For example, the air inlet hole 146 is formed on one side of the air pulverizing pipe peripheral surface being in contact with an inner lower surface 155 of the chamber body 152. Accordingly, the water accumulated in the chamber body 152 can flow to the air inlet hole 146. In some implementations, one side surface of the chamber body 152 facing the air inlet hole 146 may be open. For example, the chamber cover 154 is disposed on the opened side surface of the chamber body 152 facing the air inlet hole 146. In some implementations, the chamber cover 154 may cover the opened side surface of the chamber body 152. The chamber cover 154 includes the outside air inlet 168 where the outside air flows. In addition, the chamber cover 154 includes an external connection pipe 166 which protrudes outward in a portion where the outside air inlet 168 is formed. A separate connection hose which is connected to the outside of the cabinet 20 may be mounted on the external connection pipe 166.

In some implementations, the air chamber 150 may include an air guide pipe 158 which extends along the inner lower surface 155 of the air chamber 150 in the air inlet hole 146. The air guide pipe 158 expands a path where the noise is propagated inside the air chamber 150 to reduce the noise. The air guide pipe 158 forms the inner lower surface 155 of the chamber body 152.

In some implementations, the air pulverizing pipe 110 may include an air tab mounting portion 116 which is formed to mount the air tab 180 above the extended pipe portion 136. The air tab mounting portion 116 is formed to have a size to mount the air tab 180 inside the air tab mounting portion 116. The air tab 180 is detachably mounted on the air tab mounting portion 116. For example, when the air pulverizing pipe 110 is mounted on the tub 24, the air tab mounting portion 116 is disposed above the air pulverizing pipe 110. The air tab mounting portion 116 is disposed above the second pipe 130 of the air pulverizing pipe 110 in the water flowing direction.

The air tab mounting portion 116 is attached to the air tab 180. The air tab mounting portion 116 includes a fastening groove 117 which is formed to correspond to a fastening protrusion 186 of the air tab 180. The air tab mounting portion 116 is disposed above the bottom surface 25 of the tub 24.

In some implementations, the air pulverizing pipe 110 may include a tub mounting portion 137 which is attached to the bottom surface 25 of the tub 24. The tub mounting portion 137 is formed on an outer periphery of the air pulverizing pipe 110 which is on the upper side of the second pipe 130. In some implementations, the tub mounting portion 137 is formed on the outer peripheral surface of the air tab mounting portion 116. The tub mounting portion 137 includes an upper fixing plate 138 which circumferentially protrudes from an outer peripheral surface of the air pulverizing pipe 110 and an upper fixing portion 140 which passes through a lower hole of the bottom surface 25 of the tub 24 and protrudes upward from the bottom surface 25 of the tub 24. The upper fixing portion 140 is fastened to the fixing ring 190. In some implementations, the tub mounting portion 137 may have a plate shape extending radially from an upper peripheral surface of the air jet generator 100 and is in close contact with the bottom surface 25 of the tub 24 and below the bottom surface 25 of the tub 24.

The upper fixing plate 138 is formed in a ring shape protruding outward along the outer periphery of the air pulverizing pipe 110. The upper fixing plate 138 is disposed below the bottom surface 25 of the tub 24. The upper fixing plate 138 is disposed to face the bottom surface 25 of the tub 24. The upper fixing plate 138 prevents the air pulverizing pipe 110 from moving upward from the bottom surface 25 of the tub 24. For example, the upper fixing plate 138 is disposed below the bottom surface 25 of the tub 24 and is disposed to be in close contact with the bottom surface 25 of the tub 24.

The upper fixing portion 140 has a tubular shape protruding upward from the upper fixing plate 138, passes through the lower hole formed in the bottom surface 25 of the tub 24, and is disposed above the bottom surface 25 of the tub 24.

A portion of the upper fixing portion 140 is disposed above the bottom surface 25 of the tub 24. The upper fixing portion 140 forms a thread to fasten the fixing ring 190 to the outer peripheral surface of the air pulverizing pipe 110. The bottom surface 25 of the tub 24 is disposed between the upper fixing plate 138 and the fixing ring 190 fastened to the upper fixing portion 140. The upper fixing portion 140 is coupled to the fixing ring 190 and prevents the air pulverizing pipe 110 from moving downward. The upper fixing portion 140 engages with the fixing ring 190 so that the bottom surface 25 of the tub 24 and the upper fixing plate 138 come into close contact with each other.

The fixing ring 190 has a ring shape and is fastened to the upper fixing portion 140 of the air pulverizing pipe 110. An inner peripheral surface 192 of the fixing ring 190 has a thread corresponding to the upper fixing portion 140. In the fixing ring 190, a plurality of reinforcing ribs 194 which maintain rigidities of the fixing ring 190 and function as a handle is formed along an outer periphery. The reinforcing ribs 194 are formed to be perpendicular to an outer peripheral surface of the fixing ring 190 at regular intervals.

The air pulverizing pipe 110 includes an upper portion which is disposed above the bottom surface 25 of the tub 24 and a lower portion which is disposed below the bottom surface 25 of the tub 24. The upper portion and the lower portion of the air pulverizing pipe 110 can be classified based on the upper fixing plate 138 of the tub mounting portion 137. In the lower portion of the air pulverizing pipe 110, the first pipe 120, the air inlet hole 146, and the second pipe 130 are disposed. In the upper portion of the air pulverizing pipe 110, the air tab mounting portion 116 is disposed.

The air pulverizing pipe 110 is fastened to the tub 24 between the second pipe 130 and the air tab mounting portion 116 where the air tab 180 is mounted. In some implementations, a large amount of air is pulverized by the second pipe 130 and the air tab 180, and vibrations and the noise may be generated. However, the air jet generator 100 is fixed to the tub 24 at the second pipe 130 and the portion adjacent to the air tab 180 where the vibrations are generated. Accordingly, the air jet generator 100 may reduce the vibrations generated in the air pulverizing pipe 110.

The bottom surface 25 of the tub 24 is disposed between the upper fixing plate 138 of the air pulverizing pipe 110 and the fixing ring 190. A sealer 196 for preventing the water flowing on the bottom surface 25 of the tub 24 from leaking downward from the bottom surface 25 of the tub 24 is disposed between the upper fixing plate 138 of the air pulverizing pipe 110 and the fixing ring 190. For example, the sealer 196 may be disposed below and/or above the bottom surface 25 of the tub 24.

A lower peripheral plate 142 which extends radially from an outer peripheral surface is formed on a lower end portion of the air pulverizing pipe 110. The lower peripheral plate 142 may form a surface parallel to the upper fixing plate 138 formed in the upper end portion of the air pulverizing pipe 110.

In some implementations, the lower peripheral plate 142 may have a ring shape extending radially on the outer peripheral surface of the first pipe 120. However, the lower peripheral plate 142 forms a cut surface **142*a* on a surface which comes into contact with a first plate 29*a* of the air jet generator fixing portion 29. The cut surface 142*a* of the lower peripheral plate 142 comes into contact with the first plate 29*a* and restricts a forward-backward movement of the air jet generator 100**.

The air pulverizing pipe 110 includes the reinforcing protrusions 112 which are formed to reinforce rigidities of the air pulverizing pipe 110 on the outer periphery where the first pipe 120 and the second pipe 130 are formed. The reinforcing protrusions 112 may reinforce the first pipe 120 and the second pipe 130 which are formed to be long with a relatively small diameter.

The reinforcing protrusions 112 are formed to protrude from the outer periphery of the air pulverizing pipe 110 in a length direction in which the first pipe 120 and the second pipe 130 form the channel. Four reinforcing protrusions 112 may be formed on the outer peripheral surface of the air pulverizing pipe 110 at an interval of 90°.

The reinforcing protrusion 112 connects the upper fixing plate 138 and the lower peripheral plate 142, and is disposed to be perpendicular to the upper fixing plate 138 and the lower peripheral plate 142.

The air pulverizing pipe 110 includes a base fixing portion 113 which fixes a lower portion of the air jet generator 100 to the base 28. The base fixing portion 113 protrudes to have a rib shape outward from the air pulverizing pipe 110 and is mounted on the base 28. The base fixing portion 113 may include the fixing rib 114 which protrudes outward from a peripheral surface of the air pulverizing pipe 110 and extends in the up-down direction.

The air pulverizing pipe 110 may include the fixing rib 114 which protrudes outward from the peripheral surface of the air pulverizing pipe 110 and extends in the up-down direction to be mounted on the base 28. The fixing rib 114 may be one of the plurality of reinforcing protrusions 112 which are formed on the outer periphery of the air pulverizing pipe 110. The fixing rib 114 may form a rib which further protrudes outward than the other reinforcing protrusions 112 formed on the outer periphery of the air pulverizing pipe 110.

The fixing rib 114 is fixed to the air jet generator fixing portion 29 of the base 28 to be attached to the lower portion of the air jet generator 100. The fixing rib 114 is formed inside an outer end portion of the upper fixing plate 138.

Figure 8:
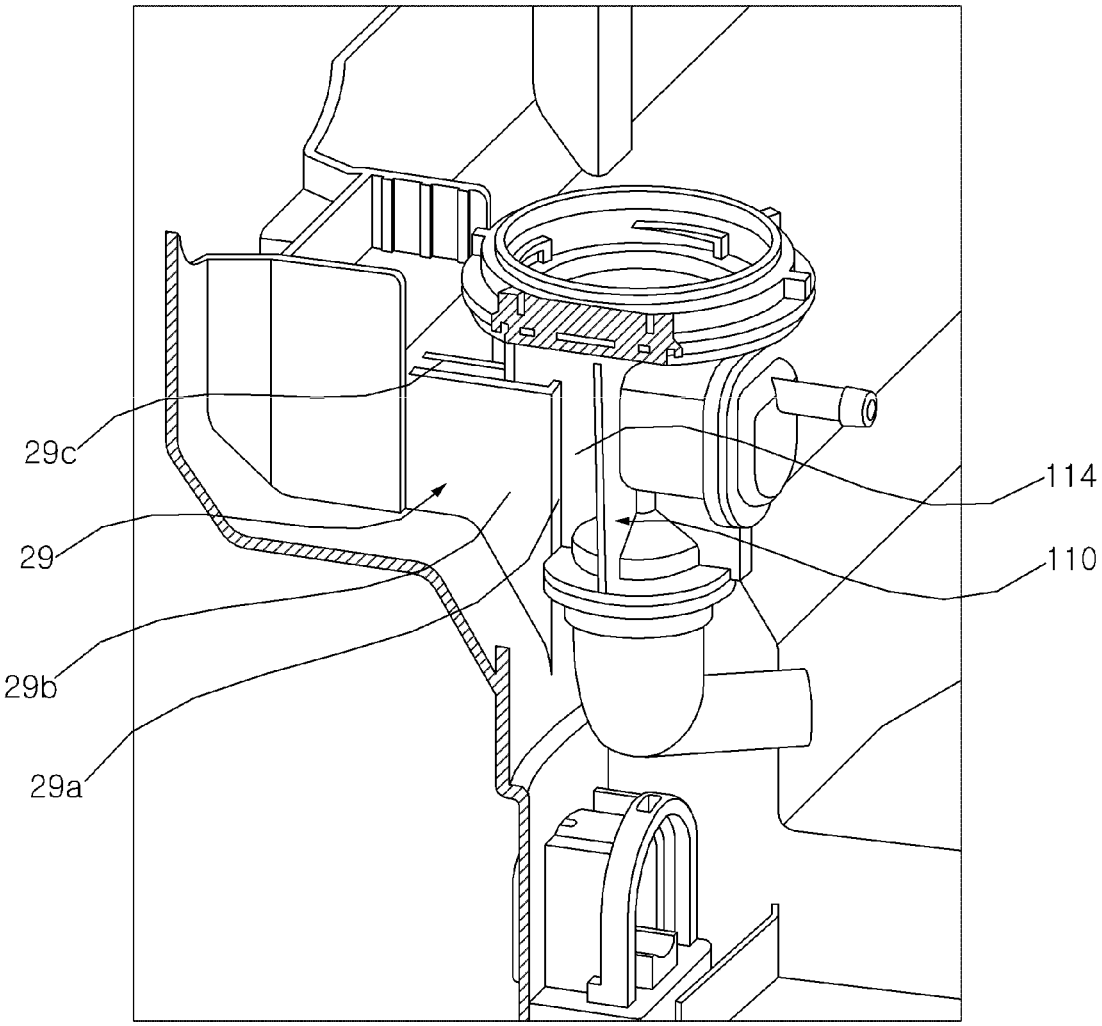
FIG. 8 is an exemplary diagram illustrating a side perspective view of the air pulverizing pipe mounted on the base.
Figure 9:
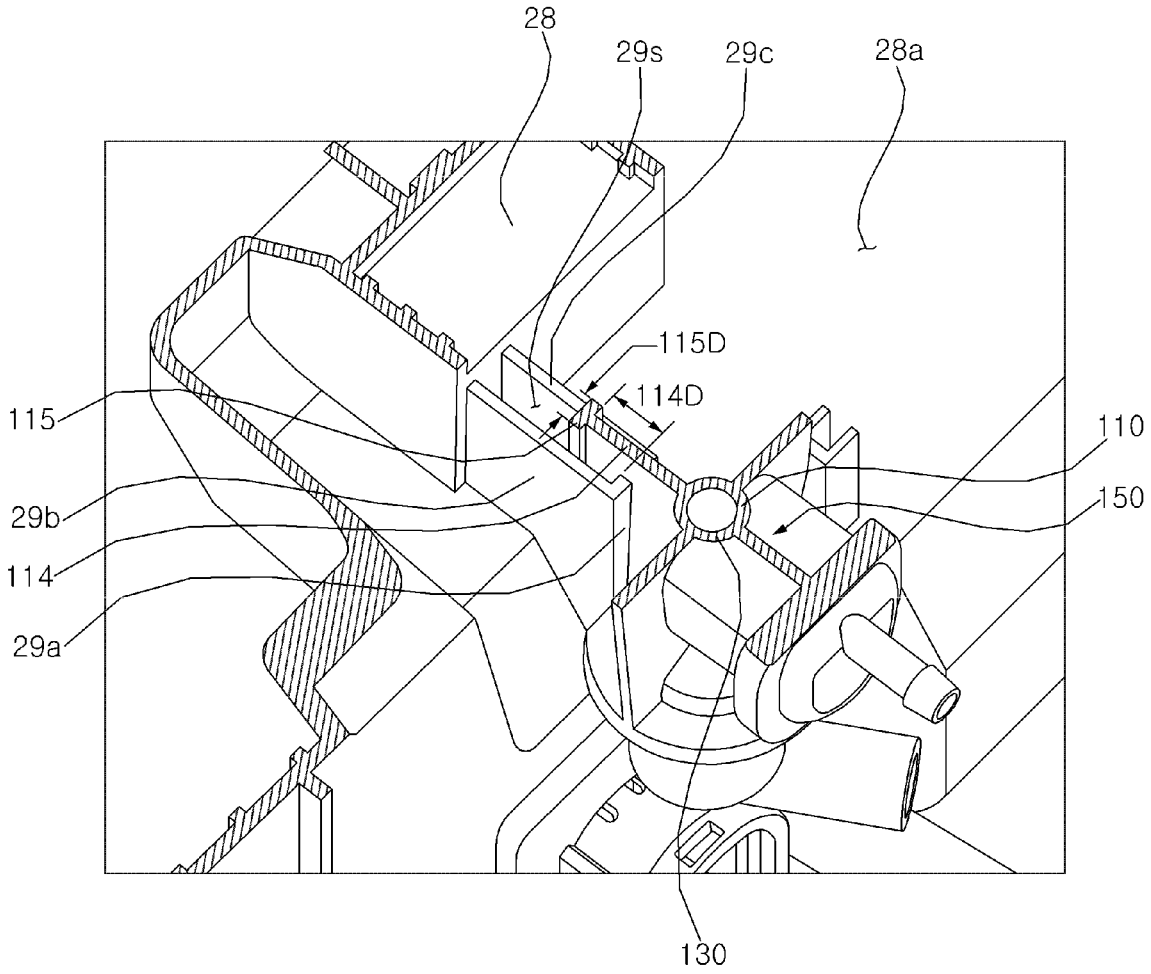
FIG. 9 is an exemplary diagram illustrating a view of the air pulverizing pipe mounted on the base.

Referring to FIGS. 8 and 9, the air jet generating fixing portion 29 is connected to the fixing rib 114 of the air pulverizing pipe 110 to be attached to the lower portion of the air jet generator 100. The air jet generator fixing portion 29 protrudes upward from the bottom surface of the base 28 and forms a rib insertion space 29*s* where the fixing rib 114 is inserted.

The air jet generator fixing portion 29 includes a first plate 29*a* which is inserted into a fixing rib groove 114*a* (in FIGS. 3, 5, 6A and 6B) of the fixing rib 114, and a pair of second plates 29*b* and 29*c* which extends to be perpendicularly bent from both ends of the first plate 29*a* and is in contact with both ends of a vertical protrusion 115 which is perpendicularly formed in both directions from an end portion of the fixing rib 114.

The first plate 29*a* and the second plates 29*b* and 29*c* are connected to each other, and extend upward from a bottom surface 28*a* of the base 28. The first plate 29*a* and the second plate 29*b* and 29*c* are disposed to be perpendicular to each other.

The first plate 29*a* fixes the air jet generator 100 in the forward-backward direction. The pair of second plates 29*b* and 29*c* fix the air jet generator 100 in the right-left direction.

The first plate 29*a* and the pair of second plates 29*b* and 29*c* form a rib insertion space 29*s* where an insertion portion 114*b* of the fixing rib 114 is inserted. The insertion portion 114*b* of the fixing rib 114 inserted into the rib insertion space 29*s* fixes the air jet generator 100 in the forward, backward, right, left directions.

The fixing rib 114 includes the fixing rib groove 114*a* which is inserted into the first plate 29*a* of the air jet generator fixing portion 29. The fixing rib groove 114*a* is formed upward from a lower end portion of the fixing rib 114. The first plate 29*a* is inserted into the fixing rib groove 114*a* which is formed upward from the lower end portion of the fixing rib 114.

The vertical protrusion 115 which is perpendicularly bent in the fixing rib and extends in both directions is formed on the outer end portion of the fixing rib 114. The vertical protrusion 115 forms a surface perpendicular to the fixing rib 114 and both end portions of the vertical protrusion 115 abut on the pair of second plates 29*b* and 29*c*.

The fixing rib 114 includes a strength reinforcement rib 114*c* which extends from an outer peripheral surface of the air pulverizing pipe 110, and the insertion portion 114*b* which extends outward from the strength reinforcement rib 114*c* and is inserted into rib insertion space 29*s* of the air jet generator fixing portion 29. The fixing rib groove 114*a* is formed between the strength reinforcement rib 114*c* and the insertion portion 114*b*.

A length of the fixing rib 114 extending radially outward from the fixing rib groove 114*a* decreases from the upper end of the fixing rib groove 114*a* to the lower end thereof. A length 114D of the fixing rib 114 which extends radially outward from the fixing rib groove 114*a* on the upper end of the fixing rib groove 114*a* is longer than a length 115D of the vertical protrusion 115 which is formed in the right-left direction on the upper end of the fixing rib groove 114*a*.

The insertion portion 114*b* is formed on the end portion of the fixing rib groove 114*a*, is in contact with the first plate 29*a*, and prevents the air pulverizing pipe 110 from moving in the forward-backward direction. Both end portions of the vertical protrusion 115 formed on the end portion of the insertion portion 114*b* are in contact with the pair of second plates 29*b* and 29*c*, and thus, the insertion portion 114*b* prevents the air pulverizing pipe 110 from moving in the right-left direction.

A lower end portion of the insertion portion 114*b* includes an inclined surface 114*b*1 which is formed to facilitate the insertion of the first plate 29*a*. The inclined surface 114*b*1 is formed radially outward of the air jet generator in the lower end portion of the insertion portion 114*b*.

The air tab 180 has a disk shape and includes a plurality of holes 182 penetrating the air tab 180. The water passing through the second pipe 130 passes through the air tab. The air in the water is thirdly pulverized while passing the plurality of holes 182 formed in the air tab 180.

The holes 182 formed in the air tab 180 are densely disposed in the air tab 180 having a disk shape at regular intervals. For example, the air tab 180 may include holes or through holes which are formed in one direction. In addition, the holes 182 may be cross long holes in which oval holes formed in upward and downward direction and oval holes formed perpendicular to the upward and downward direction are coupled.

As a contact area between the hole 182 and the air bubbles increases, a shearing force acting on the air bubbles and a generation amount of air bubbles increase, and thus, the long hole may be more preferable than the through hole. However, if a size of the hole like the cross long hole excessively increases, reliability of the air tab may decrease. Accordingly, the long hole may be preferable. If the size of the hole formed in the air tab increases, the size of the pulverized air may increase. Accordingly, in order to generate micro bubbles, it may be preferable that the hole formed in the air tab has a predetermined size or less.

The air tab 180 includes an air tab plate 181 in which the holes 182 are formed and forming a surface perpendicular to the flow direction of the water, an air tab peripheral surface 184 which extends in a direction perpendicular to the peripheral surface of the air tab plate 181, and a fastening protrusion 186 which protrudes radially outward on one side of the air tab peripheral surface 184.

In some implementations, the air tab peripheral surface 184 may extend downward from the air tab plate 181. The air tab plate 181 and the air tab peripheral surface 184 may be formed in one implementation, but may be also be formed in separate implementations.

The air tab peripheral surface 184 may have a cylindrical shape having a hollow inner portion. The air tab plate 181 is disposed above the air tab peripheral surface 184. The inner peripheral surface 185 of the air tab peripheral surface 184 is mounted on the air pulverizing pipe 110, and forms a channel to which the water inside the air pulverizing pipe 110 flows. The inner peripheral surface of the air tab peripheral surface 184 may have the same diameter as that of the extended pipe portion of the air pulverizing pipe 110.

The fastening protrusion 186 meshes with the fastening groove 117 of the air tab mounting portion 116 to be fastened thereto, and fixes the air tab 180 so that the air tab 180 is disposed inside the air pulverizing pipe 110.

The air tab 180 may be attached to or detached from the air pulverizing pipe 110 upward. Accordingly, when soil is accumulated in the air tab and the channel air tab is blocked, the air tab 180 may be detached from the air pulverizing pipe 110 to remove the soil.

An upper portion of the air tab 180 is coupled to the nozzle 200. The air tab 180 and the nozzle 200 may be coupled to each other by a fusion method.

The air tab 180 may include a fastening member 188 for fastening the nozzle 200 disposed above the air tab 180. The fastening member 188 is formed to protrude upward on the upper portion of the air tab 180 and may have a groove where a fastening hook 202 formed in the nozzle 200 can be inserted. The fastening member 188 of the air tab 180 is fastened to the fastening hook 202 of the nozzle 200, and thus, the nozzle 200 and the air tab 180 can be fixed to each other.

The nozzle 200 is disposed above the air pulverizing pipe 110. The nozzle 200 is disposed above the air jet generator 100 and discharges the water passing through the air jet generator 100 to the inside of the tub 24. Moreover, the nozzle 200 is disposed above the air tab 180. The nozzle 200 may be coupled to the air tab 180 by a fusion method.

A lower side of the nozzle 200 is formed to be in close contact to an upper side of the air tab 180. The nozzle 200 may include the fastening hook 202 which is fastened to the fastening member 188 of the air tab 180. The nozzle 200 is coupled to the air tab 180. Accordingly, the user may rotate the nozzle protruding upward from the bottom surface 25 of the tub 24 to separate the air tab from the air pulverizing pipe 110.

In some implementations, the nozzle has a cylindrical shape including a hollow inside. The nozzle 200 may include an inflow hole 206 which the water passing through the air tab 180 flows, and a plurality of discharge holes 204*a*, 204*b*, and 204*c* discharging the water to the tub 24 are formed on a peripheral surface of the upper portion of the nozzle 200. The plurality of discharge holes 204*a*, 204*b*, and 204*c* are formed at regular intervals along the peripheral surface of the nozzle 200. The plurality of discharge holes 204*a*, 204*b*, and 204*c* are formed along the peripheral surface of the nozzle 200, and thus, the water including the air bubbles can be discharged to the bottoms surface of the tub 24 in various ways.

The nozzle 200 may include three discharge holes 204*a*, 204*b*, and 204*c*. The three discharge holes 204*a*, 204*b*, and 204*c* may be disposed to be separated from each other at regular angles along the peripheral surface of the nozzle 200. Each of the plurality of discharge holes 204*a*, 204*b*, and 204*c* is formed at an angle θ of 70° to 90°, and thus, increase a spray range of the washing waster sprayed to the bottom surface 25 of the tub 24. The three discharge holes 204*a*, 204*b*, and 204*c* can be opened at angles different from each other.

While three discharge holes are described in the present disclosure, it is appreciated that any number of discharge holes can be implemented.

The nozzle 200 includes a nozzle upper portion which forms an upper surface, and a nozzle lower portion which is connected to a bottom of the nozzle upper portion and is mounted on an upper portion of the air tab peripheral surface 184.

The nozzle upper portion and the nozzle lower portion are connected to each other, and thus, the plurality of discharge holes 204*a*, 204*b*, and 204*c* are formed on the peripheral surface of the nozzle 200. The nozzle upper portion and the nozzle lower portion may be coupled to each other in a fusion method. In the nozzle, the nozzle upper portion and the nozzle lower portion are not separated from each other, and may be integrated with each other. The nozzle lower portion includes a fastening hook 202 which is coupled to the fastening member 188 of the air tab peripheral surface 184. A plurality of fastening hooks 202 are formed along a lower peripheral surface of the nozzle lower portion. The plurality of fastening hooks 202 may be separated from each other at regular intervals along the lower peripheral surface of the nozzle lower surface.

The water including the air bubbles through the air jet generator 100 is discharged to the bottom surface of the tub 24 and flows to the sump 26. As the water flows to the bottom surface of the tub 24, the bottom surface of the tub 24 can be washed.

In the air jet generator 100, the channel where the water flows is disposed to be perpendicular to the ground of the bottom surface of the tub 24. Accordingly, it may be possible to minimize a region in which the water flowing through the second pipe 130 cannot flow due to a rapid expansion of the channel in the second pipe upper portion 134.

Figure 7:
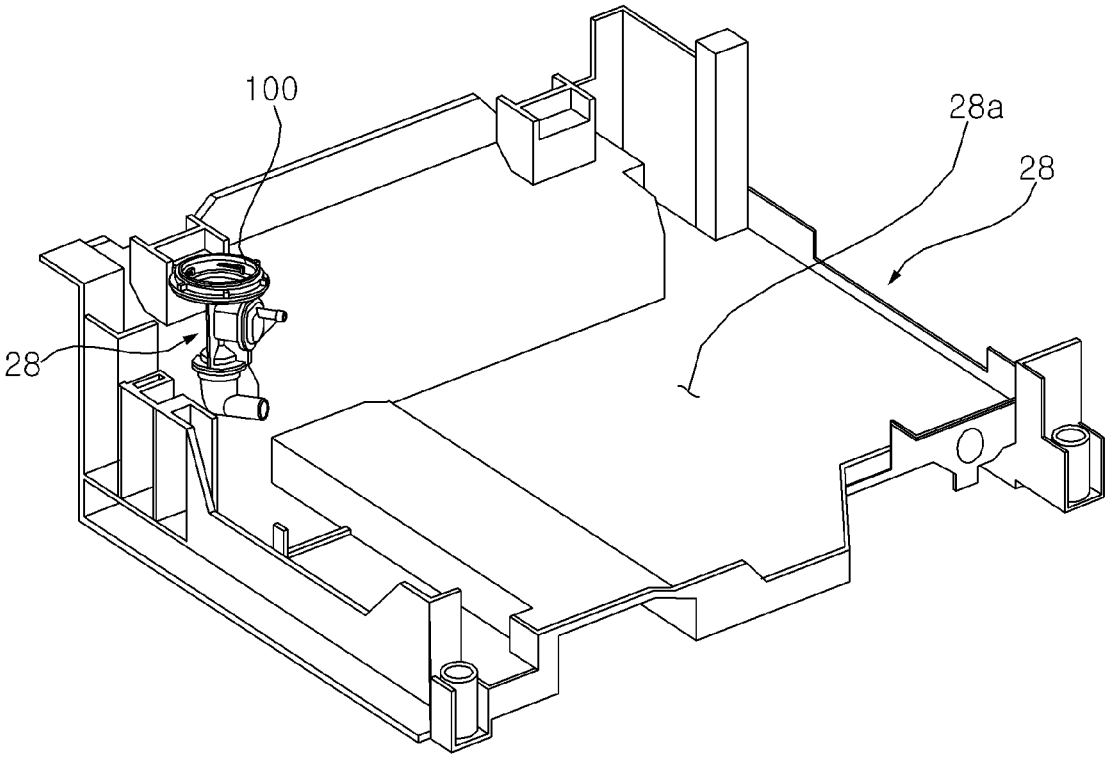
FIG. 7 is an exemplary diagram illustrating a perspective view of the air pulverizing pipe mounted on a base.
Figure 10:
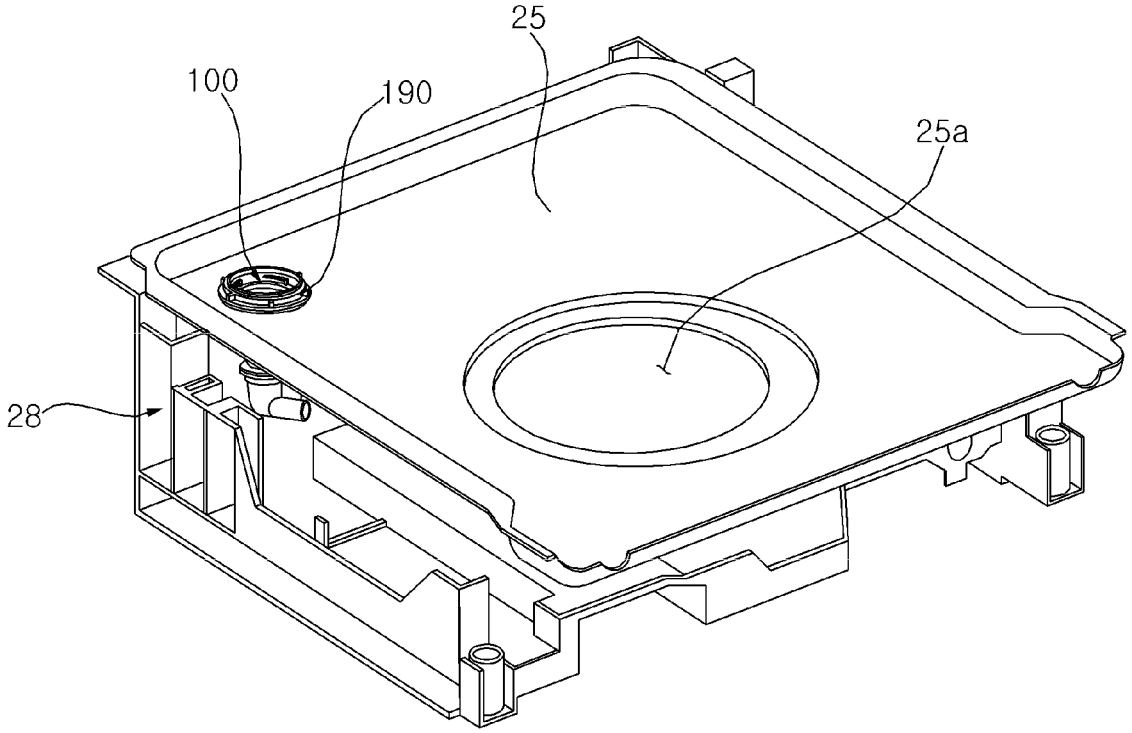
FIG. 10 is an exemplary diagram illustrating a perspective view of a bottom surface of a tub mounted on the base on which the air pulverizing pipe is mounted.

When an installation process of the air jet generator is described with reference to FIGS. 7, 10, and 11, the air pulverizing pipe 110 of the air jet generator 100 is mounted on the base 28. In this case, the fixing rib 114 of the air pulverizing pipe 110 is mounted on the air jet generator fixing portion 29 of the base 28.

Thereafter, the tub 24 is disposed above the base 28, and the upper fixing portion 140 of the air pulverizing pipe 110 is fitted into the lower hole formed in the bottom surface 25 of the tub 24. Thereafter, the fixing ring 190 is coupled to the upper fixing portion 140, and thus, the air pulverizing pipe 110 can be fixed. In this case, the fixing rib 114 of the air jet generator 100 is fixed to the base 28, the lower portion of the air jet generator is fixed, the tub mounting portion 137 is fixed to the tub 24, and thus, the upper portion of the air jet generator can be fixed.

Therefore, the air jet generator 100 is stably mounted on the base 28 and the tub 24, and thus, it may be possible to prevent the air jet generator 100 from being damaged by vibrations generated when the dish washer 10 is carried. Thereafter, as illustrated in FIG. 11, the nozzle 200 to which the air tab 180 is connected can be mounted on the upper side of the air pulverizing pipe 110.

The present disclosure, as described above, may be replaced, modified and changed in various different forms without departing from the technical spirit of the disclosure by one having ordinary skill in the art to which the disclosure pertains. Thus, the present disclosure should not be construed as being limited to the embodiments and drawings set forth herein.

According to the dish washer of the present disclosure, the following one or more effects can be obtained.

First, the upstream side and the downstream side of the air jet generator where the water flows are mounted on and fixed to the tub and the base, respectively, and thus, the air jet generator can be stably disposed and fixed even when external vibrations are applied.

Second, in the structure in which the water flows upward, the upper portion of the air jet generator is fixed to the tub in the up-down direction and the lower portion thereof is fixed to the base in forward, backward, right, and left directions. Accordingly, the air jet generator is fixed in six directions as a whole, and thus, damages of the air jet generator may be prevented while the air jet generator is carried.

Effects of the present disclosure are not limited to the above-described effects, and other effects not mentioned are clearly understood by a person skilled in the art from descriptions of claims.

What is claimed is:

1. A dish washer comprising:

a tub defining a washing space;

a base disposed below the tub and defining a space below the tub;

a sump disposed in the space defined by the base and configured to store water;

a washing pump disposed in the space defined by the base and configured to supply the water stored in the sump to the washing space; and an air jet generator having a venturi shape including (i) an air inlet provided on one side, (ii) an inlet having a downward opening, and (iii) an outlet provided above a bottom surface of the tub, wherein the air jet generator is configured to receive a portion of the water discharged from the washing pump and generate air bubbles in the water, wherein the air jet generator includes (i) a first fixture fixing an upper portion of the air jet generator to the bottom surface of the tub and (ii) a second fixture disposed below the first fixture, the second fixture coupling a lower portion of the air jet generator to the base and including a fixing rib that (i) protrudes outward from a peripheral surface of the air jet generator, (ii) extends vertically, and (iii) is coupled to the base, and wherein the base includes:

a first plate in contact with the fixing rib and configured to limit a longitudinal movement of the air jet generator, and a pair of second plates extending in one direction from the first plate and spaced apart from each other to limit a lateral movement of the air jet generator.

2. The dish washer of claim 1, wherein the first plate includes a fixing groove mounting a portion of the fixing rib, and wherein the fixing groove is opened upward.

3. The dish washer of claim 1, wherein the fixing rib includes a fixing rib groove, the fixing rib groove provided towards an upward direction in a lower end portion of the fixing rib, and wherein the first plate is inserted into the fixing rib groove.

4. The dish washer of claim 1, wherein a vertical protrusion is disposed at an end portion of the fixing rib, and wherein the vertical protrusion is disposed perpendicular to the fixing rib and is adjacent to each of the pair of second plates.

5. The dish washer of claim 4, wherein the each of the pair of second plates is disposed to be in contact with the vertical protrusion.

6. The dish washer of claim 1, wherein the first fixture has a plate shape extending radially from an upper peripheral surface of the air jet generator and is in contact with the bottom surface of the tub and below the bottom surface of the tub.

7. The dish washer of claim 6, wherein the first fixture includes (i) an upper fixing plate which circumferentially protrudes on an outer peripheral surface of the air jet generator and is disposed below the bottom surface of the tub and (ii) an upper fixing portion which passes through a lower hole provided in the bottom surface of the tub, the upper fixing portion protruding upward.

8. The dish washer of claim 7, further comprising:

a fixing ring coupled to the upper fixing portion and configured to limit a downward movement of an air pulverizing pipe included in the air jet generator.

9. The dish washer of claim 8, wherein the fixing ring provides a plurality of reinforcing ribs.

10. The dish washer of claim 9, wherein the plurality of reinforcing ribs is provided perpendicular to an outer peripheral surface of the fixing ring at regular intervals.

11. The dish washer of claim 8, further comprising a sealer disposed between the upper fixing plate and the fixing ring.

12. The dish washer of claim 8, wherein the upper fixing portion provides a thread to fasten the fixing ring to the outer peripheral surface of the air pulverizing pipe included in the air jet generator.

13. The dish washer of claim 7, wherein the upper fixing portion has a tubular shape protruding upward from the upper fixing plate.

14. The dish washer of claim 7, further comprising a lower peripheral plate provided on a lower end portion of an air pulverizing pipe included in the air jet generator and providing a surface parallel to the upper fixing plate.

15. The dish washer of claim 14, wherein the lower peripheral plate has a ring shape extending radially on an outer peripheral surface of a first pipe included in the air jet generator.

16. The dish washer of claim 14, wherein the lower peripheral plate provides a cut surface configured to limit a longitudinal movement of the air jet generator.

17. The dish washer of claim 1, wherein the air jet generator includes:

an air pulverizing pipe including a first pipe providing (i) an inlet at a lower side of the air pulverizing pipe, (ii) an opening in a water flowing direction, and (iii) a cross-sectional area reducing in the water flowing direction, and a second pipe disposed above the first pipe, the second pipe providing (i) an opening in the water flowing direction and (ii) a cross-sectional area increasing in the water flowing direction, and an air tab disposed at an upper portion of the second pipe and vertically provided with a plurality of air holes in the second pipe, and wherein an air inlet hole is provided around a peripheral surface of the second pipe to communicate with an external component through an inlet end portion of the second pipe.

18. The dish washer of claim 17, wherein the first fixture is provided on an upper end portion of the second pipe, and wherein the second fixture base fixing portion extends downward from the first fixture tub mounting portion and is provided to extend to the first pipe.

19. The dish washer of claim 1, wherein the first plate and the pair of second plates are connected to each other and extend upward from a bottom surface of the base.

20. The dish washer of claim 1, wherein the first plate and the pair of second plates are perpendicular to each other.

* * * * *